US011365609B2

(12) United States Patent
Warren

(10) Patent No.: US 11,365,609 B2
(45) Date of Patent: Jun. 21, 2022

(54) INFLOW CONTROL DEVICE BYPASS AND BYPASS ISOLATION SYSTEM FOR GRAVEL PACKING WITH SHUNTED SAND CONTROL SCREENS

(71) Applicant: HALLIBURTON ENERGY SERVICES, INC., Houston, TX (US)

(72) Inventor: Caleb Thomas Warren, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 703 days.

(21) Appl. No.: 16/323,764

(22) PCT Filed: Jul. 31, 2018

(86) PCT No.: PCT/US2018/044526
§ 371 (c)(1),
(2) Date: Feb. 6, 2019

(87) PCT Pub. No.: WO2019/032334
PCT Pub. Date: Feb. 14, 2019

(65) Prior Publication Data

US 2021/0381345 A1 Dec. 9, 2021

Related U.S. Application Data

(60) Provisional application No. 62/542,628, filed on Aug. 8, 2017.

(51) Int. Cl.
*E21B 43/04* (2006.01)
*E21B 43/08* (2006.01)
(Continued)

(52) U.S. Cl.
CPC ..... *E21B 43/04* (2013.01); *E21B 33/1208* (2013.01); *E21B 43/08* (2013.01); *E21B 43/12* (2013.01)

(58) Field of Classification Search
CPC ..... E21B 43/04; E21B 43/08; E21B 43/12; E21B 33/1208
See application file for complete search history.

(56) References Cited

U.S. PATENT DOCUMENTS 7,407,007 B2 8/2008 Tibbles
7,673,678 B2 3/2010 MacDougall et al.
(Continued)

FOREIGN PATENT DOCUMENTS

WO WO-2010028158 A1 3/2010
WO WO-2018052462 A1 3/2018

OTHER PUBLICATIONS

French Patent Office, Search Report, dated Apr. 6, 2020, 6 pages, France.

(Continued)

*Primary Examiner* — Catherine Loikith
(74) *Attorney, Agent, or Firm* — Haynes and Boone, LLP

(57) ABSTRACT

Bypass modules may be employed in a gravel packing operation to facilitate a sufficiently rapid dehydration of a gravel slurry in a wellbore. The bypass modules include a material which swells in response to contact between the material and fluid in a well such that flow through the bypass module may be prohibited once the gravel packing operation is complete such that production fluids may flow through screens and associated ICDs to enter an inner diameter of a completion string. The bypass modules may be disposed at a tee junction in a leak-off conduit, at an end portion of the leak-off conduit and/or independent of a leak-off conduit.

20 Claims, 7 Drawing Sheets

(51) Int. Cl.
*E21B 43/12* (2006.01)
*E21B 33/12* (2006.01)

(56) References Cited

U.S. PATENT DOCUMENTS

| | | | | |
|---|---|---|---|---|
| 7,708,068 | B2 | 5/2010 | Hailey, Jr. | |
| 7,984,760 | B2 | 7/2011 | Haberle et al. | |
| 8,127,831 | B2 * | 3/2012 | Haeberle | E21B 43/08 166/51 |
| 10,107,093 | B2 * | 10/2018 | Yeh | E21B 43/088 |
| 10,808,506 | B2 * | 10/2020 | Riisem | E21B 43/08 |
| 10,851,623 | B2 * | 12/2020 | Coffin | E21B 43/10 |
| 2007/0246213 | A1 | 10/2007 | Hailey, Jr. | |
| 2011/0120726 | A1 | 5/2011 | Murray et al. | |
| 2012/0018153 | A1 | 1/2012 | Yeh et al. | |
| 2013/0206394 | A1 | 8/2013 | Garcia et al. | |
| 2015/0027700 | A1 | 1/2015 | Riisem et al. | |
| 2017/0022789 | A1 | 1/2017 | Hodge et al. | |

OTHER PUBLICATIONS

Korean Intellectual Property Office, International Search Report and Written Opinion, PCT/US2018/044526, dated Nov. 14, 2018, 17 pages, Korea.

* cited by examiner

INFLOW CONTROL DEVICE BYPASS AND BYPASS ISOLATION SYSTEM FOR GRAVEL PACKING WITH SHUNTED SAND CONTROL SCREENS

CROSS REFERENCE TO RELATED APPLICATION(S)

This application is a U.S. national stage patent application of International Patent Application No. PCT/US2018/044526, filed on Jul. 31, 2018, which claims priority to U.S. Provisional Application No. 62/542,628 filed Aug. 8, 2017, entitled "Inflow Control Device Bypass and Bypass Isolation System for Gravel Packing with Shunted Sand Control Screens," the disclosures of which are hereby incorporated by reference in their entireties.

BACKGROUND

The present disclosure relates generally to equipment and operations for use in a subterranean wellbore. Example embodiments described herein include equipment and operations for gravel packing a wellbore in connection with the production of hydrocarbons or other fluids from geologic formations.

Often wells are completed with sand control screens for inhibiting sand production into a base pipe of a completion string, e.g., a production tubing string extending to the surface. Many wells are benefited by additionally having a gravel pack placed around the sand control screens. Furthermore, some well completions are benefited by having flow restrictors, such as inflow control devices (ICDs), integral to the screens or fluidly coupled to the screens to restrict the flow of produced fluid through the screens. In some cases, the inflow control devices may variably restrict the fluid flow, and may have the capability to respond to changed downhole conditions and/or be remotely controlled (e.g., "autonomous" and/or "intelligent" inflow control devices). Very long horizontal open hole completions can also benefit substantially from the use of inflow control devices fluidly coupled to the screens.

Conventional slurry pumping techniques used in gravel packing operations may involve flowing gravel into a wellbore with a carrier fluid. The gravel pack may then be dehydrated by flowing the carrier fluid through the screens in order to return the carrier fluid to the surface while the gravel remains in place. Generally, greater flow rates through the screen at certain points in the gravel packing operation may facilitate a successful gravel packing operation. However, the presence ICDs associated with the screens may significantly restrict the available flow rate through the screen during the gravel packing operation.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes bypass modules that may be used in a gravel packing operation to facilitate a sufficiently rapid dehydration of a gravel slurry. The bypass modules provide a relatively unrestricted flow path for a carrier fluid to enter a base pipe of a production tubing string during a gravel packing operation, and close once the gravel packing operation is complete such that production fluids may flow through well screens and associated ICDs to enter the base pipe of the production tubing string. The bypass modules may include a swellable member therein that swells to thereby close the bypass module in response to contact with a trigger fluid present or provided into a wellbore. At least some of the bypass modules may be disposed at a tee junction in a leak-off conduit extending longitudinally along the base pipe, at an end portion of the leak-off conduit and/or independent of any leak-off conduit or well screen.

Figure 1:
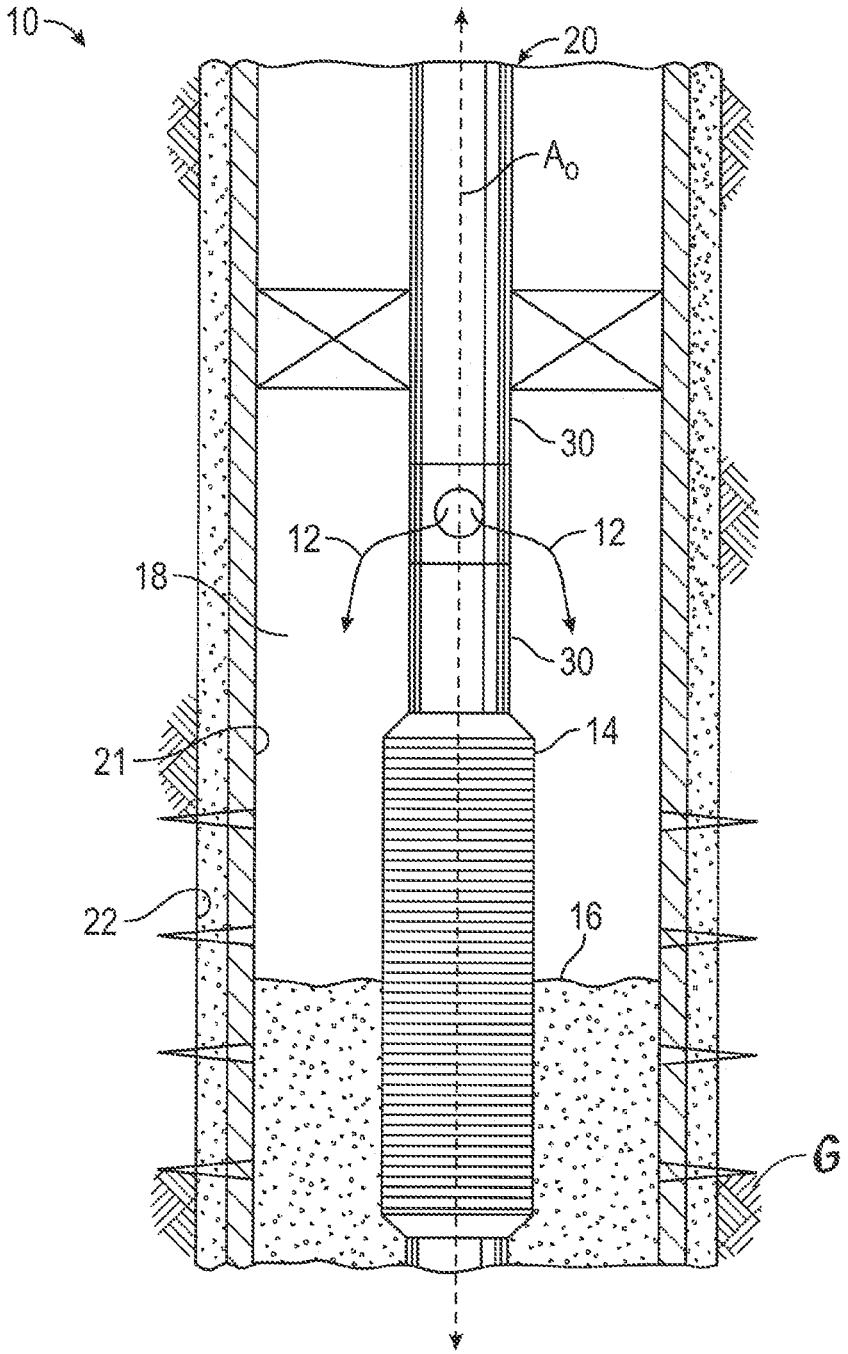
FIG. 1 is a partial cross-sectional side view of a gravel pack installed in a wellbore, which may employ a wellbore system embodying principles of the present disclosure.

FIG. 1 generally illustrates a well system 10 defined within a subterranean geologic formation "G," in which a gravel packing operation is being performed. A gravel slurry 12 is being flowed into an annulus 18 defined between a completion string 20 and casing string 21 disposed in a wellbore 22. In this manner, a gravel pack 16 is installed about a well screen 14 interconnected in the completion string 20. The well screen 14 may be provided with a flow restricting device such as an ICD 36 (see FIG. 2) for restricting inward flow through the well screen 14 during production.

The completion string 20 includes a base pipe 30 defining a longitudinal axis Ao. The base pipe 30 may extend to the surface and may serve as a conduit for both the gravel slurry 12 to travel downhole into the wellbore 22 and for the carrier fluids and/or production fluids to flow uphole. A bypass module 100 (see FIG. 2) independent of the well screen 14 may also be interconnected in the completion string 20 for permitting a relatively unrestricted inward flow into the base pipe 30 of the completion string 20 until after the gravel packing operation is complete. This combination of the ICD 36 and the bypass module 100 allows greater flow rates into the completion string 20 before and during the gravel packing operation, and also provides the benefits of reduced flow rates through the well screen 14 during production.

Although the wellbore 22 is depicted in FIG. 1 as being cased with casing string 21, it should be understood that the wellbore 22 could be completed open hole in keeping with the principles of the present disclosure. In addition, although the well screen 14 is shown as being positioned in a generally vertical portion of the wellbore 22, such well screens and other equipment described herein may alternatively, or in addition, be positioned in horizontal or otherwise deviated portions of a wellbore.

Figure 2:
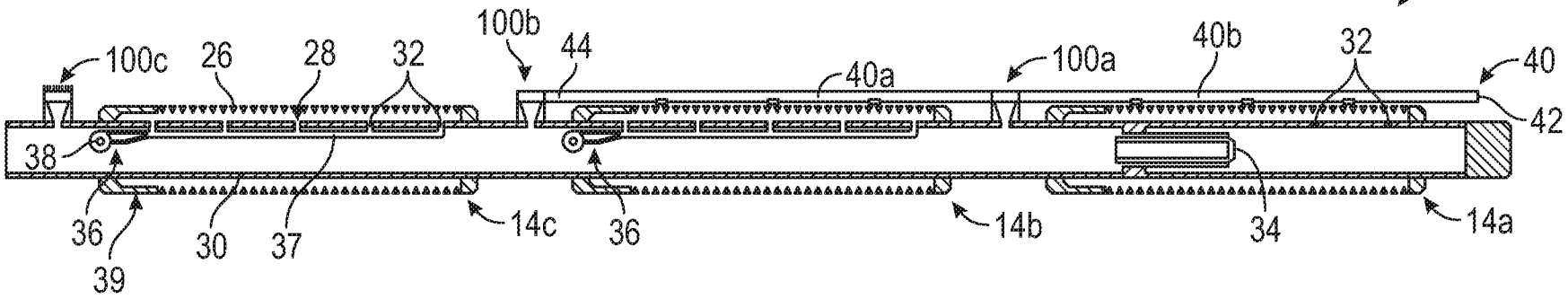
FIG. 2 is a partial schematic view of a wellbore system illustrating a plurality of bypass modules of the present disclosure with a plurality of screens installed on a tubing string.

FIG. 2 is a partial cross-sectional side view of a larger portion of the completion string 20 illustrated in FIG. 1. The portion of the completion string 20 illustrated in FIG. 2, may be coupled below the portion illustrated in FIG. 1, for example. The portion of the completion string 20 illustrated in FIG. 2 includes three well screens 14 (14*a*, 14*b* and 14*c*) interconnected therein, and three bypass modules 100 (100*a*, 100*b* and 100*c*), which are axially spaced along the completion string and independent from the well screens 14. The well screens 14 include a filter portion 26, which may be constructed of wire wrap as illustrated, or other types of filter material (such as mesh, sintered material, etc.) in other embodiments. After passing through the filter portion 26 of the well screen 14, fluids may enter an annular space 28 disposed radially between the filter portion 26 and a tubular base pipe 30 of the completion string 20 or well screen 14. From the annular space 28, fluid may enter the base pipe 30 through openings or ports 32, and from the base pipe 30 fluids may flow to the surface.

The well screen 14*a* defined at a lowermost portion of the completion string 20 may be a "sacrificial screen," which may be employed for relatively unrestricted intake of a carrier fluid during a gravel pack operation, and closed or isolated from the completion string 20 by a plug 34 or other device once a gravel pack operation is complete and/or prior to commencing production through the completion string 20. The ports 32 in the sacrificial well screen 14*a* may extend directly through the base pipe 30 such that fluid may flow relatively unrestricted into the interior of the completion string 20. Once the gravel pack 16 (FIG. 1)_is sufficiently dehydrated, the plug 34 may be positioned by manipulating a washpipe (not shown) or other tool from the surface, or may be remotely controlled from the surface such that the plug 34 may be positioned without physical intervention. In other embodiments, the sacrificial well screen 14*a* may be eliminated or replaced with a well screen 14*b*, 14*c* having an ICD 36 or other flow restrictor fluidly coupled thereto.

In the well screens 14*b* and 14*c*, a flow restrictor such as ICDs 36 may be provided that restrict the flow into the base pipe 30 of the completion string 20. Generally, ICDs 36 may be fluidly coupled anywhere between the annular space 28 and the interior of the base pipe 30. As illustrated in FIG. 2, the ports 32 extend from the annular space 28 to a longitudinal flow passageway 37 that is fluidly coupled to the ICDs 36. Often, in other embodiments, (not shown) ICDs are joined, e.g., to a longitudinal end of a screen jacket 39, and receive fluid directly from the annular space 28 through the screen jacket 39. As illustrated in FIG. 2, ICDs 36 are autonomous flow control devices that include a plurality of pathways between the ports 32 and an exit port 38 extending radially into the base pipe 30. The pathway taken by fluid flowing through the ICD 36 may depend on or change along with a characteristic of the fluid flowing therethrough, and flow resistance may be dependent on the particular path taken through the ICD 36. A flow path through the ICD 36 is described below with reference to FIG. 4B. In other embodiments, the flow restrictors may be "intelligent" in that they may be remotely controlled and/or are capable of responding to sensed downhole conditions in order to variably restrict inward flow therethrough. In this regard, intelligent flow restrictors may include a downhole controller and/or a telemetry device for communicating with the surface or another remote location. In still other embodiments, the flow restrictor may simply be constriction, tortuous pathway or other mechanism for resisting fluid flow therethrough.

A leak-off conduit 40 is provided on an exterior of the screens 14 and may be constructed of a plurality of sections 40*a*, 40*b*. The leak-off conduit 40 includes provides an interior longitudinal pathway for the transport of fluids such as production fluids and the carrier fluids in gravel slurry longitudinally along the completion string 20. The leak-off conduit 40 extends across a plurality of the well screens 14. Specifically, in the embodiment illustrated, the leak-off conduit 40 extends across the well screen 14*b* and the sacrificial screen 14*a*. In this manner, the leak-off tube 40 may provide a dehydration path to the sacrificial screen 14*a* from the positions of other well screens 14. In other embodiments, one or more leak-off conduits may be provided each extending a greater or lesser length along the completion string 20. An outer circumferential wall of the leak-off conduit 40 may be perforated or otherwise fluid permeable to permit the entry or exit of fluids into or from an interior of the leak-off conduit 40. The circumferential wall may exhibit a rectangular cross section as illustrated, or any other another appropriate geometry. A lower end 42 of the leak-off conduit may also be open or fluid permeable to permit entry of fluids therethrough.

The bypass modules 100*a* and 100*b* are fluidly coupled to the leak-off conduit 40 and provide a relatively unrestricted fluid pathway between the leak-off conduit 40 and the interior of the base pipe 30. The bypass module 100*a* is arranged along the leak off conduit 40 to interrupt the flow path to the sacrificial screen 14*a* provided by the leak-off conduit 40. For example, at least a portion of fluid flowing through the leak off conduit 40 toward the sacrificial screen may enter the base pipe 30 through the bypass module 100*a*. A portion of the fluid may also continue through the bypass module 100*a*, and continue through the leak off conduit 40 toward the sacrificial screen 14*a*. The bypass module 100*b* is arranged at an upper end 44 leak-off conduit 40, and may discharge fluid received from the surrounding formation "G" into the base pipe 30 and/or into the leak-off conduit 40. The bypass module 100*c* is positioned remotely from the leak-off conduit 40 and may provide a pathway from a formation "G" surrounding the wellbore 22 (FIG. 1) into the interior of the base pipe 30. Other positions and arrangements of bypass modules may be provided within the scope of the present disclosure.

The bypass modules 100 are arranged to provide a relatively unrestricted inlet to the base pipe 30 during a gravel packing operation, but as described in greater detail below, may be sealed to prevent any flow therethrough during a production phase such that production fluids may enter the base pipe 30 primarily through the ICDs 36 associated with the well screens 14*b* and 14*c*. As described above, the sacrificial well screen 14*a* may be also isolated from the interior of the base pipe 30 during the production phase. Thus, during the production phase, the ICDs 36 may provide the least restrictive pathway for production fluids to enter the base pipe 30.

Figure 3A:
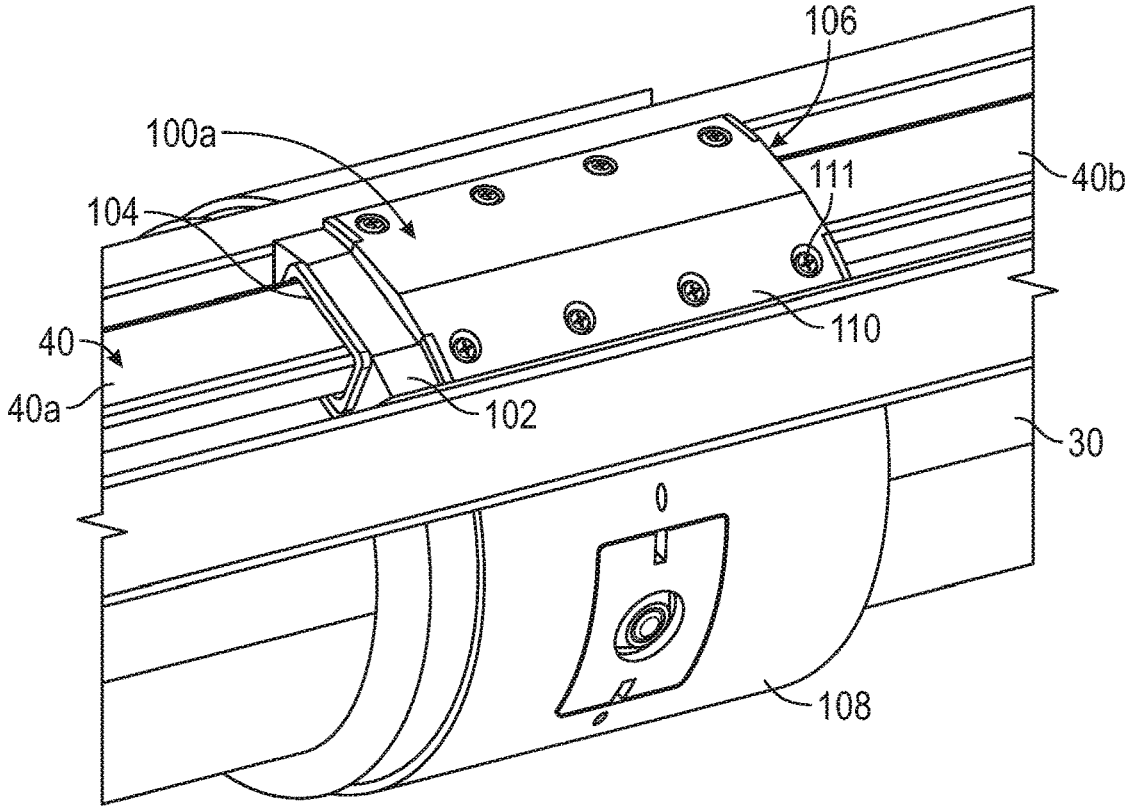
FIG. 3A a perspective view of one of the bypass modules of FIG. 2 illustrating the bypass module installed between two sections of a leak-off conduit.

FIG. 3A a perspective view of the bypass module 100*a* arranged between the two sections 40*a*, 40*b* of the leak-off conduit 40. The bypass module 100*a* defines a longitudinal fluid pathway between the two sections 40*a*, 40*b* of the leak-off conduit 40 and includes a housing 102. The housing 102 has openings 104, 106 defined therein for receiving or otherwise coupling to a longitudinal end of the sections 40*a*, 40*b* of the leak-off conduit 40. The housing 102 includes a structural support 108 that may circumscribe the base pipe 30 and facilitate coupling the bypass module 100*a* to the base pipe 30 by welding, fasteners, or other connection mechanisms. The bypass module 100*a* also includes a removable cover 110 coupled to the housing 102 by fasteners 111. The cover 110 extends generally over the fluid pathway between the sections 40*a*, 40*b* of the leak-off conduit 40. As illustrated, the housing 102 and the cover 110 may be constructed of steel or another generally fluid impermeable material such that fluids entering bypass module 100*a* generally enter through the leak-off conduit 40 or the openings 104, 106. In other embodiments, (see FIG. 4A) openings may be provide through the cover, housing, structural support or other components to permit fluid to enter the bypass module 100*a*.

Figure 3B:
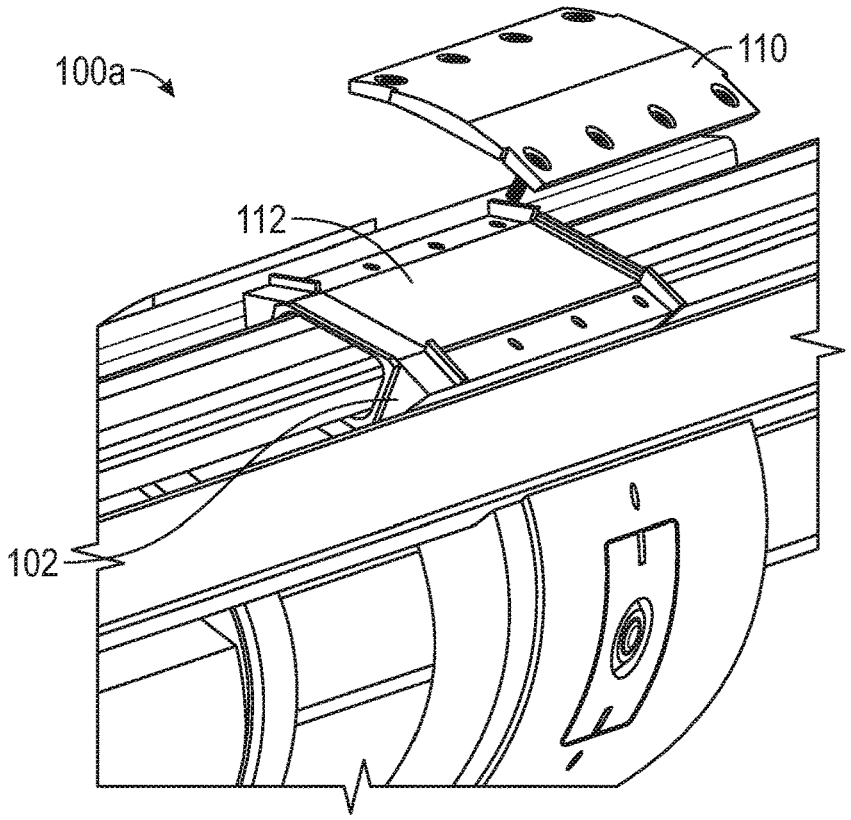
FIG. 3B is a partially exploded perspective view of the bypass module of FIG. 3A with a cover removed to illustrate a swellable tee installed in the bypass module.

FIG. 3B is a partially exploded perspective view of the bypass module 100*a* with the cover 110 removed from the housing 102. A swellable member 112 is disposed within the housing 102 beneath the cover 110, and is responsive to contact with a particular trigger fluid present in the wellbore 22 (FIG. 1) or to be injected into the wellbore 22. The removability of the cover 110 allows for changing swellable member 112, e.g., at the surface to have a material responsive to a desired trigger fluid prior to deployment. The swellable member 112 may be maintained in a first un-swollen configuration (see FIG. 5A) prior to contact with the trigger fluid and may be induced to increase in volume to thereby move to a swollen configuration (see FIG. 6A) when exposed to the trigger fluid. When the swellable member 112 is in the first or un-swollen configuration, the swellable member 112 is constructed as a "tee" such that fluid may flow longitudinally through the swellable member 112 between the two sections 40*a*, 40*b* of the leak-off conduit 40 and/or radially into the base pipe 30. When the swellable member 112 is in the second or swollen configuration (see FIGS. 6A and 6B), the flow through the bypass module 100*a* is prohibited.

Swelling of the swellable member 112 may be initiated during or after the gravel packing operation by, e.g., circulating the trigger fluid downhole through the completion string 20 with, or after, the slurry 12 (FIG. 1). Alternatively, the trigger fluid may be a production fluid, e.g., oil, natural gas or other hydrocarbons, water, etc. produced from the geologic formation "G". The swellable member 112 may be constructed of a rubber material such as EPDM, natural rubber or brombutyl rubber. These materials, when exposed to a hydrocarbon-based trigger fluid, swell and retain the trigger fluid to maintain the swollen configuration. In other embodiments, the swellable member 112 may be constructed of a swelling clay such as bentonite that expands in the presence of water. One skilled in the art will recognize that a variety of other materials may be employed depending on the particular application.

Figure 3C:
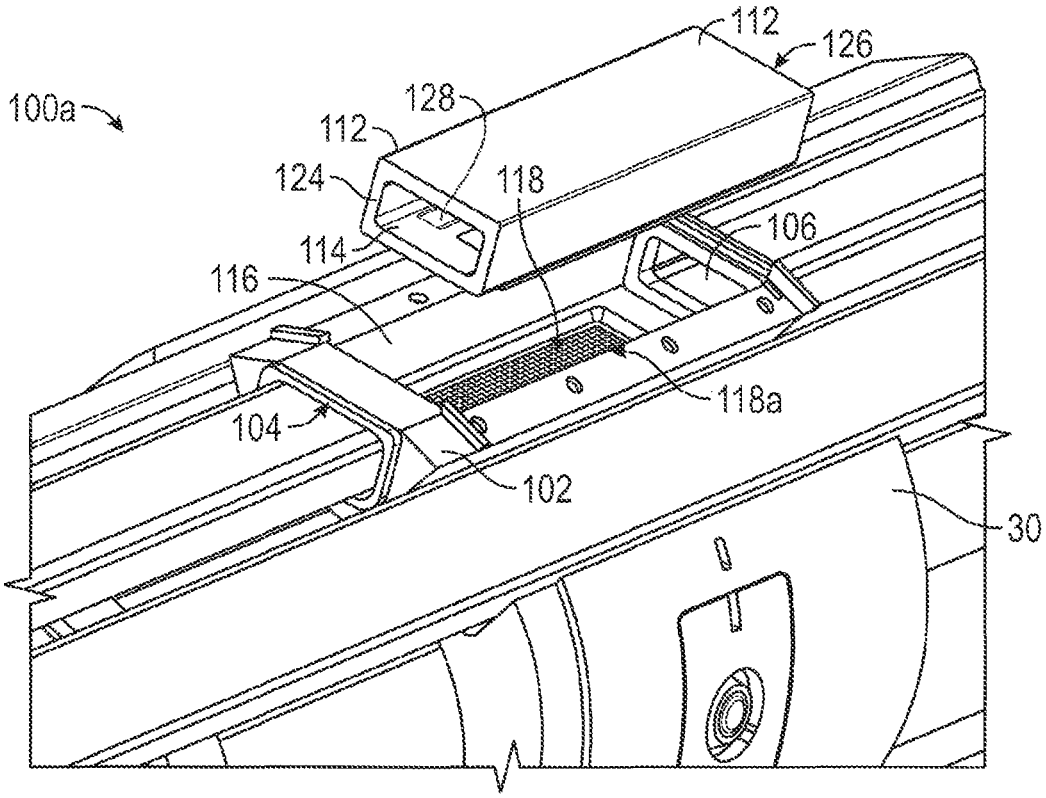
FIG. 3C is a partially exploded perspective view of the bypass module of FIG. 3B with the swellable tee removed illustrating screened ports extending to an inner passageway of a tubing string base pipe.

FIG. 3C is a partially exploded perspective view of the bypass module 110*a* with the swellable member 112 removed from the housing 102. A chamber 116 is defined in the housing 102 between the openings 104, 106 for receiving the swellable member 112. A radially interior surface of the chamber 116 includes screened ports 118 extending into the interior of the base pipe 30. The screened ports 118 may be covered with a port screen member 118*a* such as a mesh or any of the materials described above for use in the filter portion 26 of the well screens 14 (FIG. 2). The port screen member 118*a* may be disposed within the interior of the chamber 116 in some embodiments, or coupled to an exterior of the bypass module 110*a* over the screened ports 118. The screened ports 118 permit sand or other particles in the carrier fluids that have not passed through a filter portion 26 of any screen (see FIG. 2) to be separated from the carrier fluid entering the base pipe 30.

In the un-swollen configuration illustrated, the swellable member 112 defines an interior tee-shaped passageway 114. The tee-shaped passageway 114 extends between openings 124, 126 on longitudinal ends of the swellable member 112 and a radial opening 128 on a lower end thereof. The openings 124, 126 are positioned to communicate with the corresponding openings 104, 106 defined in the housing 102, and the opening 128 is positioned to communicate with the screened ports 118.

When the swellable member 112 is induced to swell, the opening 128 is closed and a pressure seal is established over the screened ports 118 to prohibit entry of fluids into the base pipe 30 through the bypass module 100*a*. The swelling may also close, or partially close, the openings 124, 126 such that migration of fluids between the sections 40*a*, 40*b* of the leak-off tube 40 is hindered or prohibited.

Figure 4A:
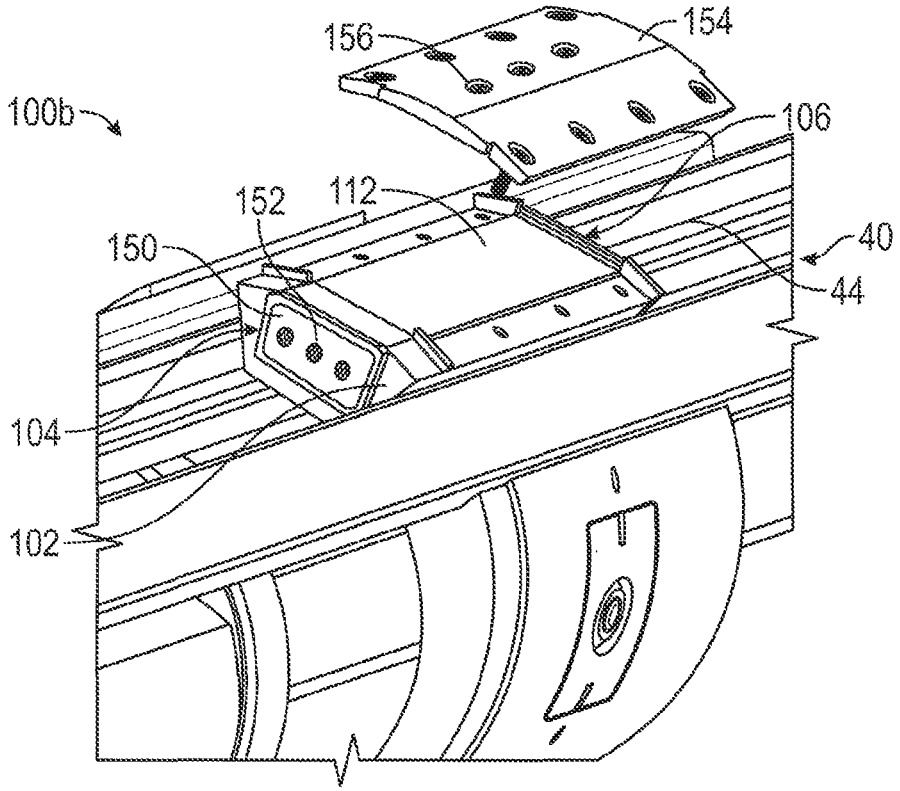
FIG. 4A is a partially exploded perspective view of another one of the bypass modules of FIG. 2 illustrating the bypass module installed on an end of the leak-off conduit.

FIG. 4A is a partially exploded perspective view of the bypass module 100*b* disposed at the upper end 44 of the leak-off conduit 40. The bypass module 100*b* also includes a housing 102 with openings 104, 106 defined therein. The opening 106 receives section 40*a* of the leak-off conduit 40, which extends from the opening 106 of the bypass module 100*b* to opening 104 of the bypass module 100*a* (FIG. 3A). The opening 104 of the bypass module 100*b*, however, does not connect with the leak-off conduit 40, and thus, may be covered by a plate 150. The plate 150 may include screened openings 152 defined therein, which may permit entry of fluids from the wellbore 22 to enter the bypass module 100*b*. A cover 154 coupled with the housing 102 may also be provided with screened openings 156 defined therein to permit passage of fluids into the bypass module 100*b* from the surrounding gravel pack 16 or geologic formation "G" (FIG. 1). The screened openings 152, 156 may be closed by the operation of the swellable member 112. Although not illustrated specifically, the bypass module 100*c* (FIG. 2) may include two plates 150 covering each of the two openings 104, 106 in the housing 102 since the bypass module 100*c* is fully remote from the leak-off conduit 40.

Figure 4B:
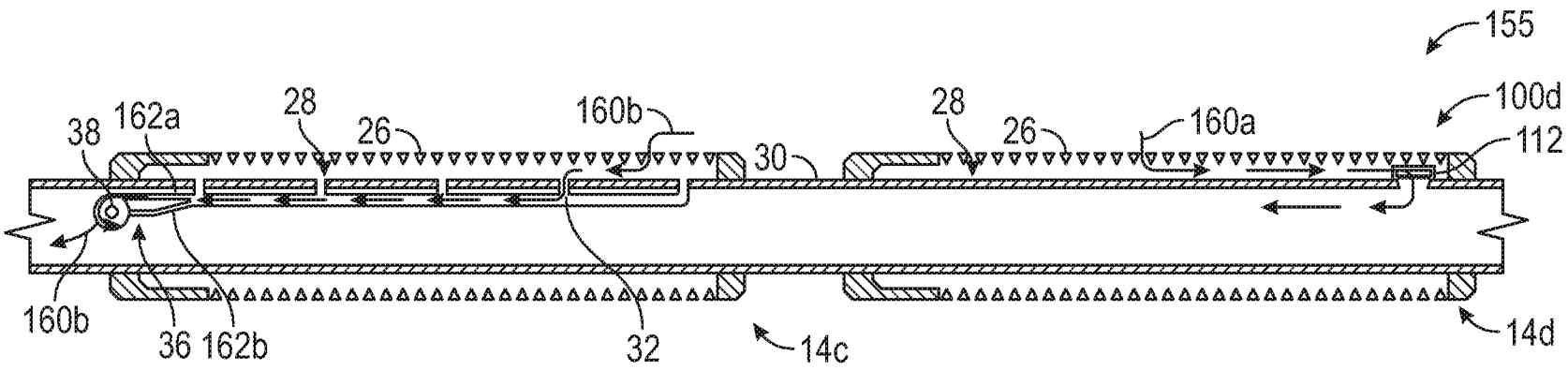
FIG. 4B is a partially schematic view of a wellbore system illustrating a bypass module installed within an annular space between a well screen and a base pipe.

FIG. 4B is a partially schematic view of a wellbore system 155 illustrating a bypass module 100*d* within a well screen 14*d*. The well screen 14*d* includes a filter portion 26 and the bypass 100*d* disposed within the annular space 28 between the filter portion 26 and the tubular base pipe 30. The bypass module 100*d* may be constructed substantially as the bypass module 100*b* (FIG. 4A) discussed above, except that the plate 150 may be removed and the cover 154 may be removed or replaced with a cover 110 without screened openings 156 defined therein. A flow path 160*a* may be defined through the filter portion 26, through the annular space 28, through the bypass module 100*d* and into the base pipe 30. The flow path 160*a* may be available for carrier fluids of the gravel slurry 12 (FIG. 1) until a trigger fluid swells the swellable member 112, thereby prohibiting flow through the bypass module 100*d* and well screen 14*d*.

An additional flow path 160*b* through the well screen 14*c* is available for production fluids once the flow through the bypass module 100*d* is prohibited. For example, the flow path 160*b* extends through the filter portion 26 of the well screen 14*c*, through the annular space 28, through the ports 32 of the ICD 36 and into the base pipe 30 through the exit port 38. Internal to the autonomous ICD 36, e.g., between the ports 32 and exit port 38, are various flow passages which a fluid takes dependent upon its characteristics (e.g., viscosity). For example, flow may be divided between flow passages 162*a*, 162*b* dependent on the viscosity of the production fluid, and the production fluid may then be induced to flow directly to the exit port or spiral toward the exit port 38. In this manner, resistance across the autonomous ICD 36 differs with the flow path taken, which is dependent upon the viscosity or other characteristic of the production fluid.

Although in FIG. 4B, the well screen 14*d* is illustrated without an ICD 36 and well screen 14*c* is illustrated without a bypass module 100 therein, in other embodiments, a single screen may incorporate both a an ICD 36 and a bypass module 100 without departing form the scope of the disclosure. Generally, the bypass modules 100 are arranged with larger passageways, e.g., tee-shaped passageway 114 (FIG. 3C), than the passageways, e.g., flow passages 162*a*, 162*b* in the ICDs 36 such that the bypass modules may permit a relatively rapid flow of fluids into the base pie 30.

Figure 4C:
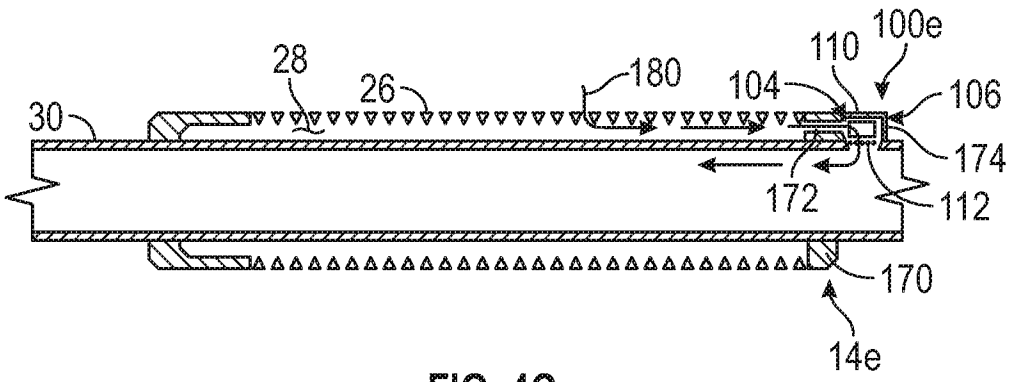
FIG. 4C is a partially schematic view of a wellbore system illustrating a bypass module fluidly coupled to the annular space between a well screen and a base pipe through a fluid passageway.

FIG. 4C is a partially schematic view of a wellbore system 164 illustrating a bypass module 100*e* having one longitudinal opening 104 fluidly coupled to the annular space 28 between the filter portion 26 and the tubular base pipe 30 of a well screen 14*e*. As illustrated, the bypass module 100*e* is affixed to the base pipe 30 adjacent an end cap 170 of the well screen 14*e*. A fluid passageway 172 extends through the end cap 170 such that fluids filtered by the filter portion 26 of the well screen 14*e* may enter the bypass module 110*e* through the opening 104. The bypass module 100*e* may include a cover 110 that does not include filtered openings 156 (FIG. 4A), and a solid plate 174 sealing the longitudinal opening 106. In this manner, fluids may be prevented from entering the bypass module 100*e* except those fluids prefiltered by the well screen 14*e*. A flow path 180 into the base pipe 30 extends through the filter portion 26, the annular space 28, the fluid passageway 172, through the opening 104 and the swellable member 112 into the base pipe 30 through the screened ports 118 (FIG. 3C). Once exposed to a trigger fluid, however, the swellable member 112 swells to prohibit flow along the flow path 180, effectively closing the well screen 14*e*.

Figure 5A:
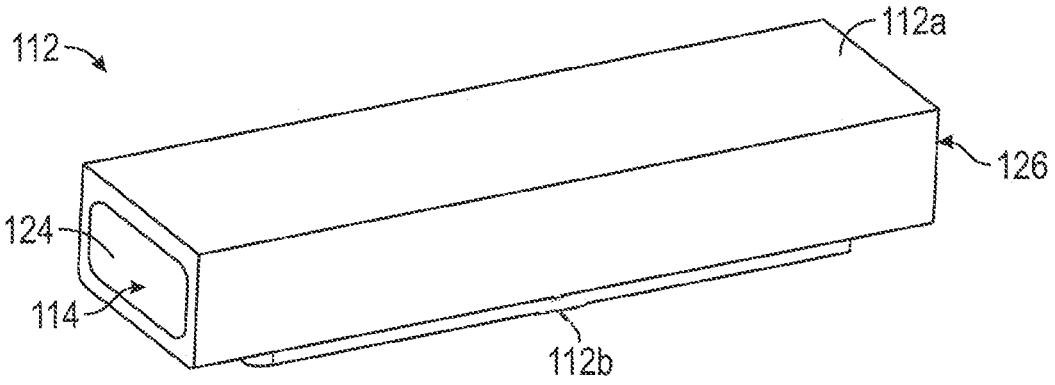
FIGS. 5A and 5B are perspective views of the swellable tee of FIG. 3B illustrating an un-swollen configuration of the swellable tee.
Figure 5B:
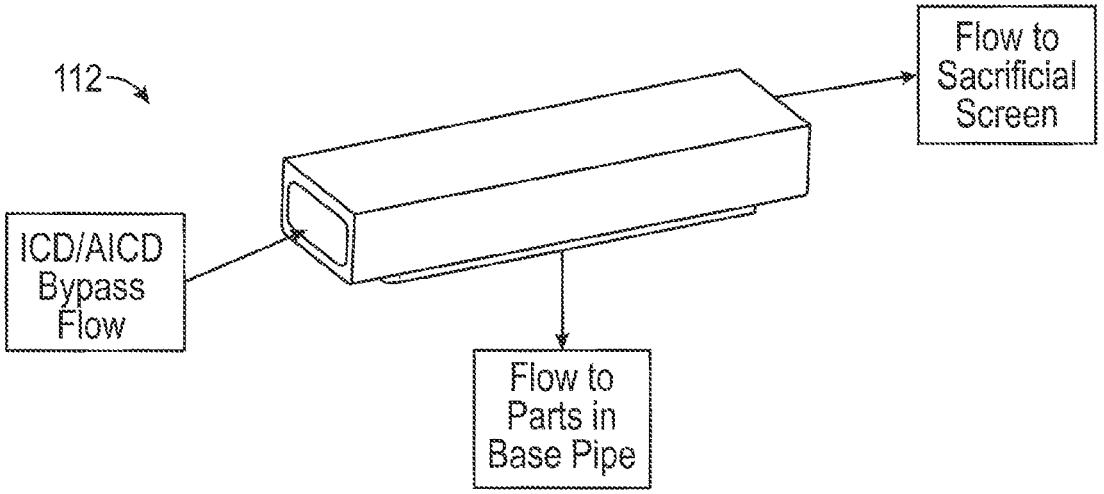

FIGS. 5A and 5B are perspective views of the swellable member 112 in the un-swollen configuration. The swellable member 112 generally provides a longitudinal flow path through the tee-shaped passageway 114 for fluids to bypass the ICDs 36 (FIG. 2). The fluids flowing through the tee-shaped passageway may travel to the sacrificial screen 14*a*, and may also travel radially to enter the base pipe 30 directly. The swellable member 112 includes a main cross member 112*a* extending between the openings 124 and 126 and a radial extension 112*b* protruding from the main cross member 112*a*. The radial extension may facilitate placement of the swellable member within the chamber 116 of a bypass module 100, and may facilitate forming a pressure seal over the screened ports 118 (FIG. 3C).

Figure 6A:
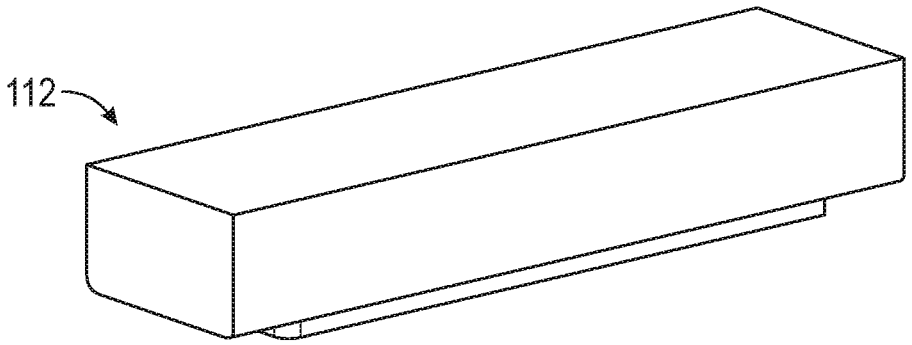
FIGS. 6A and 6B are perspective views of the swellable tee of FIGS. 5A and 5B illustrating a second swollen configuration of the swellable tee.
Figure 6B:
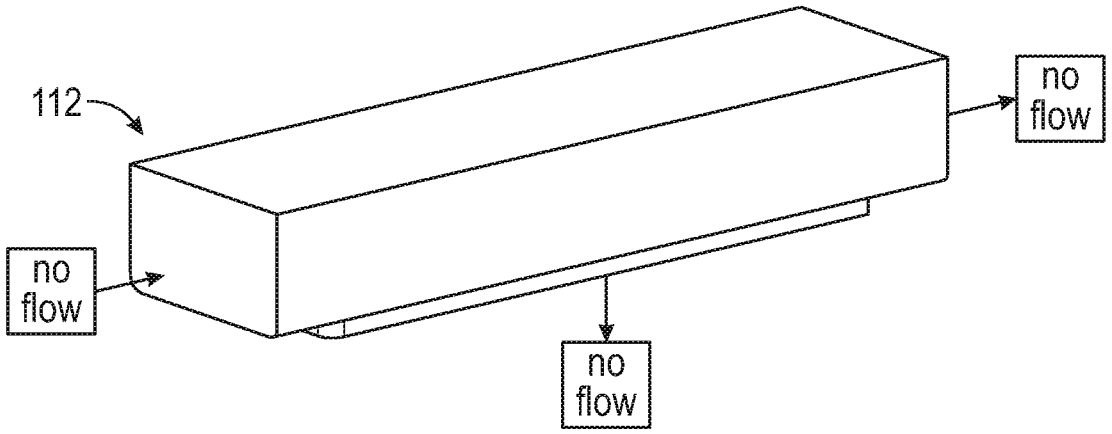

FIGS. 6A and 6B are perspective views of the swellable member 112 in the swollen configuration. The openings 124, 126 and 128 are closed such that flow through the swellable member, and thus the bypass module 100 in which the swellable member is disposed, is restricted or prohibited.

In one example operational procedure, with reference generally to FIGS. 1, 2 and 3C, the completion string 20 may be first be installed in the wellbore 22 with the swellable members 112 in the un-swollen configuration and the sacrificial screen 14*a* open. Then the gravel slurry 12 may be pumped through the work string from the surface into the annulus 18 to form the gravel pack 16. A carrier fluid in the gravel slurry 12 may enter the bypass modules 100 either directly from the annulus 18, or may travel through the leak-off conduit 40 to a bypass module 100, where the carrier fluid may enter the base pipe 30. Carrier fluids may also flow into the screens 14, although a greater amount of the carrier fluid may flow into the sacrificial screen 14*a* than through screens 14*b* and 14*c* since the sacrificial screen 14*a* lacks the ICD 36. Since the carrier fluid may flow into the base pipe 30 relatively unrestricted through the bypass modules 100 and the sacrificial screen 14*a*, the gravel pack 16 may be rapidly dehydrated to facilitate the formation of strong and consistent gravel pack 16. Once the gravel pack 16 is complete and sufficiently dehydrated, the completion string 20 may be arranged for a production phase.

The sacrificial screen 14*a* may be closed by arranging the plug 34 appropriately with respect to the base pipe 30 to prohibit inflow of fluids into the base 30 through the sacrificial screen 14*a*. Also, the swellable members 112 may be exposed to a trigger fluid such as water pumped from the surface or a hydrocarbon based production fluid entering the wellbore 22 from the surrounding formation "G". The swellable members 112 will then move to a swollen configuration to prohibit or impair fluid flow through the bypass modules 100. With the bypass modules 100 and the sacrificial screen 14*a* closed, the production fluid may primarily or only enter the base pipe 30 through the ICDs 36 associated with the screens 14*b*, 14*c*. Thus, the flow of the production fluid may be restricted as planned during the production phase.

It should be appreciated that, although the screens 14 and bypass modules 100 have been described above as being used in a gravel packing operation and in the well system 10 in which the well screens is gravel packed, it is not necessary for the screens 14 to be used in such gravel packing operations or well systems. For example, the screen 14 (or any screen incorporating principles of the invention) could be used in well systems where the screen 14 is not gravel packed, or in operations where a restriction to flow through the screen 14 is not increased in relation to any gravel packing operation.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter. According to one aspect, the disclosure is directed to a bypass module for use in a gravel pack system. The bypass module includes a housing for coupling to a base pipe of the gravel pack system. The housing defines a chamber therein extending to one or more of longitudinal openings for receiving fluids from an annulus around the base pipe and at least one port extending into an interior of the base pipe. A port screen member is coupled to the housing and extends across the at least one port. A swellable member is disposed within the chamber, and is responsive to exposure to a trigger fluid to move between an un-swollen configuration wherein fluid flow between the more than one longitudinal openings and the at least one port is permitted and a swollen configuration wherein a pressure seal is established over the at least one port to prohibit fluid through the at least one port.

In one or more example embodiments, the one or more longitudinal openings includes a pair of opposed longitudinal openings and the swellable member is constructed as a tee having a main cross member extending between the pair of longitudinal openings and a radial extension protruding from the main cross member toward the at least one port. The swellable member may be constructed of a rubber material responsive to a hydrocarbon based trigger fluid to move from the un-swollen configuration to the swollen configuration. The swellable member may substantially fill the chamber when in the swollen configuration.

In some embodiments, the bypass module further includes a cover removably coupled over the chamber. In some embodiments, the cover includes at least one screened opening defined therein for receiving fluids into the chamber. In some example embodiments, the bypass module further includes at least one plate disposed in at least one of the longitudinal openings, the at least one plate including at least one screened opening therein for passing fluid into the chamber.

According to another aspect, the disclosure is directed to a gravel pack system including a base pipe defining a longitudinal axis. At least one well screen includes a filter portion disposed radially about the base pipe and at least one port defined between an interior of the base pipe and an annular space between the filter portion and the base pip. A bypass module housing is coupled to the base pipe remotely from the at least one well screen. The housing defines a chamber therein extending to one or more of longitudinal openings and at least one port extending into an interior of the base pipe. A port screen member is coupled to the housing and extends across the at least one port. A swellable member is disposed within the chamber. The swellable member is responsive to exposure to a trigger fluid to move between an un-swollen configuration wherein fluid flow between the more than one longitudinal openings and the at least one port is permitted and a swollen configuration wherein a pressure seal is established over the at least one port to prohibit fluid through the at least one port.

According to one or more example embodiments, the at least one well screen includes a sacrificial well screen where fluid flow through the sacrificial well screen into the base pipe is substantially unrestricted and at least one other well screen having a flow restricting device for restricting fluid flow through the at least one port. In some embodiments the sacrificial well screen further includes a plug selectively operable to prohibit fluid flow through the sacrificial well screen.

In some embodiments, the gravel pack system may further include a leak-off conduit arranged on the exterior of the base pipe and having at least one section fluidly coupled to at least one longitudinal opening in the bypass module housing. The leak-off conduit may extend along the base pipe across a plurality of well screens to the sacrificial well screen. In some embodiments, the at least one bypass module further includes at least one additional bypass module disposed independently of the leak-off conduit. In some embodiments, the leak-off conduit includes an outer circumferential wall constructed of a perforated or fluid permeable material. In one or more embodiments, the flow restricting device includes an autonomous or intelligent ICD.

In another aspect, the disclosure is directed to a method of forming a gravel pack in a wellbore. The method includes (a) installing a completion string including the base pipe into a wellbore, (b) pumping a gravel slurry from the surface through the completion string to form a gravel pack in an annulus around the completion string and (c) dehydrating the gravel pack by flowing a carrier fluid from the annulus through both at least one well screen coupled in the completion string and the at least one bypass module into a base pipe of the completion string.

In one or example embodiments, the method further includes exposing a swellable member to a trigger fluid in the wellbore to move the swellable member to a swollen configuration and thereby prohibit fluid flow into the base pipe through the bypass module. The method may further include closing a sacrificial screen coupled in the completion string. The method may further include flowing the carrier fluid through a leak-off conduit and between a pair of opposed more longitudinal openings defined in a housing of the at least one bypass module. In one or more example embodiments, the method may further include restricting fluid flow between the more than one longitudinal openings by moving a swellable member within the at least one bypass module to a swollen configuration.

According to another aspect, the disclosure is directed to a well screen for use in a gravel pack system. The well screen includes a base pipe, a filter portion disposed about the base pipe and defining an annular space about the base pipe, and a bypass disposed within the annular space such that a fluid path is defined between the annular space into the interior of the base pipe through the bypass module.

According to another aspect, the disclosure is directed to a well screen for use in a gravel pack system. The well screen includes a base pipe, a filter portion disposed about the base pipe and defining an annular space about the base pipe, and a bypass module coupled around the base pipe adjacent the filter portion and having a longitudinal opening fluidly coupled to the annular space. The well screen may further include an end cap having a fluid passageway extending there through between the annular space and the longitudinal opening of the bypass module.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A bypass module for use in a gravel pack system, the bypass module comprising:

a housing for coupling to a base pipe of the gravel pack system, the housing defining a chamber therein extending to one or more of openings for receiving fluids from an annulus around the base pipe and at least one port extending into an interior of the base pipe, the one or more openings including a pair of opposed longitudinal openings;

a port screen member coupled to the housing and extending across the at least one port; and a swellable member disposed within the chamber, the swellable member constructed as a tee having a main cross member extending between the pair of longitudinal openings and a radial extension protruding from the main cross member toward the at least one port, the swellable member responsive to exposure to a trigger fluid to move between an un-swollen configuration wherein fluid flow between the more than one openings and the at least one port is permitted and a swollen configuration wherein a pressure seal is established over the at least one port to prohibit fluid through the at least one port.

2. The bypass module according to claim 1, wherein the swellable member is constructed of a rubber material responsive to a hydrocarbon based trigger fluid to move from the un-swollen configuration to the swollen configuration.

3. The bypass module according to claim 2, wherein the swellable member substantially fills the chamber when in the swollen configuration.

4. The bypass module according to claim 1, further comprising a cover removably coupled over the chamber.

5. The bypass module according to claim 1, further comprising at least one plate disposed in at least one of the longitudinal openings, the at least one plate including at least one screened opening therein for passing fluid into the chamber.

6. A bypass module for use in a gravel pack system, the bypass module comprising:

a housing for coupling to a base pipe of the gravel pack system, the housing defining a chamber therein extending to one or more of openings for receiving fluids from an annulus around the base pipe and at least one port extending into an interior of the base pipe;

a port screen member coupled to the housing and extending across the at least one port;

a swellable member disposed within the chamber, the swellable member responsive to exposure to a trigger fluid to move between an un-swollen configuration wherein fluid flow between the more than one openings and the at least one port is permitted and a swollen configuration wherein a pressure seal is established over the at least one port to prohibit fluid through the at least one port; and a cover removably coupled over the chamber wherein the cover includes at least one screened opening defined therein for receiving fluids into the chamber.

7. The bypass module according to claim 6, further comprising at least one plate disposed in at least one of the longitudinal openings, the at least one plate including at least one.

8. A gravel pack system comprising:

a base pipe defining a longitudinal axis;

at least one well screen having a filter portion disposed radially about the base pipe and at least one port defined between an interior of the base pipe and an annular space between the filter portion and the base pipe;

a leak-off conduit arranged on the exterior of the base pipe and extending across the at least one well screen;

a bypass module housing coupled to the base pipe at a junction between the leak-off conduit and the base pipe, remotely from the at least one well screen, the housing defining a chamber therein fluidly coupled to the leak-off conduit through one or more of longitudinal openings of the housing and fluidly coupled to an interior of the base pipe through at least one port extending into the interior of the base pipe;

a port screen member coupled to the housing and extending across the at least one port; and a swellable member disposed within the chamber, the swellable member responsive to exposure to a trigger fluid to move between an un-swollen configuration wherein fluid flow between the more than one longitudinal openings and the at least one port is permitted and a swollen configuration wherein a pressure seal is established over the at least one port to prohibit fluid through the at least one port.

9. The gravel pack system according to claim 8, wherein the at least one well screen includes a sacrificial well screen where fluid flow through the sacrificial screen into the at least one base pipe is substantially unrestricted and at least one other well screen having a flow restricting device for restricting fluid flow through the at least one port.

10. The gravel pack system according to claim 9, wherein the sacrificial well screen further comprises a plug selectively operable to prohibit fluid flow through the sacrificial well screen.

11. The gravel pack system according to claim 10, wherein the leak-off conduit extends along the base pipe across a plurality of well screens to the sacrificial well screen.

12. The gravel pack system according to claim 10, wherein the bypass module further includes at least one additional bypass module disposed independently of the leak-off conduit.

13. The gravel pack system according to claim 12, wherein the leak-off conduit includes an outer circumferential wall constructed of a perforated or fluid permeable material.

14. The gravel pack system according to claim 9, wherein the flow restricting device includes an autonomous or intelligent ICD.

15. A method of forming a gravel pack in a wellbore, the method comprising:

installing a completion string including a base pipe into a wellbore;

pumping a gravel slurry from the surface through the completion string to form a gravel pack in an annulus around the completion string;

dehydrating the gravel pack by flowing a carrier fluid from the annulus through at least one well screen coupled in the completion string;

dehydrating the gravel pack by flowing the carrier fluid from the annulus through at least one leak-off conduit and at least one bypass module, the leak-off arranged on the exterior of the base pipe and extending across the at least one well screen and the at least one bypass module defining a junction between the leak-off conduit and the base pipe of the completion string; and disposing a swellable member in the at least one bypass module at the junction between the leak-off conduit and the base pipe.

16. The method according to claim 15, further comprising exposing the swellable member to a trigger fluid in the wellbore to move the swellable member to a swollen configuration and thereby prohibit fluid flow into the base pipe through the at least one bypass module.

17. The method according to claim 15, further comprising closing a sacrificial screen coupled in the completion string.

18. The method according to claim 17, further comprising flowing the carrier fluid through the leak-off conduit and between a pair of opposed more than one longitudinal openings defined in a housing of the at least one bypass module.

19. The method according to claim 18, further comprising restricting fluid flow between the more than one longitudinal openings by moving the swellable member within the at least one bypass module to a swollen configuration.

20. The method according to claim 18, further comprising flowing the carrier fluid into the leak-off conduit through an outer circumferential wall constructed of a perforated or fluid permeable material.

* * * * *